United States Patent [19]

Akashi

[11] Patent Number: 4,823,447

[45] Date of Patent: Apr. 25, 1989

[54] PULL TAB ATTACHMENT FOR SLIDE FASTENER SLIDER

[75] Inventor: Shunji Akashi, Kurobe, Japan

[73] Assignee: Yoshida Kogyo K.K., Tokyo, Japan

[21] Appl. No.: 230,437

[22] Filed: Aug. 10, 1988

[30] Foreign Application Priority Data

Aug. 12, 1987 [JP] Japan ..... 62-124064[U]

[51] Int. Cl.[4] ..... A44B 19/26

[52] U.S. Cl. ..... 24/429; 24/419; 24/421

[58] Field of Search ..... 24/429, 421, 419, 437, 24/236, 420, 230, 30.5 W; 294/3.6

[56] References Cited

U.S. PATENT DOCUMENTS

| | | | |
|---|---|---|---|
| 4,389,758 | 6/1983 | Akashi | 24/429 |
| 4,512,064 | 4/1985 | Nishikawa | 24/429 |
| 4,624,032 | 11/1986 | Ishii | 24/429 |

FOREIGN PATENT DOCUMENTS

| | | | |
|---|---|---|---|
| 0958604 | 2/1957 | Fed. Rep. of Germany | 24/429 |
| 2820936 | 11/1978 | Fed. Rep. of Germany | 24/429 |
| 2803559 | 8/1979 | Fed. Rep. of Germany | 294/3.6 |
| 2069317 | 8/1981 | United Kingdom | 24/429 |

*Primary Examiner*—Victor N. Sakran

*Attorney, Agent, or Firm*—Hill, Van Santen, Steadman & Simpson

[57] ABSTRACT

A pull tab attachment for attaching a pull tab to a slider body is made of a plastically deformable material. The pull tab attachment includes a ring member on one end for being loosely fitted in a pull tab retainer on the slider body, and a pair of jaws comprising a pair of gripper arms on the opposite end for gripping an end of the pull tab therebetween. The gripper arms have on inner confronting surfaces thereof a plurality of biting teeth extending in different directions for biting engagement with the end of the pull tab gripped between the gripper arms.

8 Claims, 3 Drawing Sheets

PULL TAB ATTACHMENT FOR SLIDE FASTENER SLIDER

BACKGROUND OF THE INVENTION

1. Field of the Invention

The present invention relates to a pull tab attachment to be coupled between a slide fastener slider body and a pull tab to connect the pull tab to the slider body.

2. Description of the Prior Art

Sliders for use in slide fasteners are usually shipped and sold as comprising slider bodies and pull tabs which are coupled to each other and mounted on slide fastener chains, the slider bodies and pull tabs matching the types, shapes, dimensions, and colors of the slide fastener chains. However, to meet growing demands for more diverse kinds of articles on which slide fasteners are used, and to increase the efficiency of stitching slide fasteners to articles and allow many slide fastener types to be produced in smaller quantities, it is being practiced in the slide fastener industry to ship slide fastener chains and sliders separately, and subsequently join them together while the slide fastener chains are being stitched to desired articles.

The pull tabs of sliders are most appealing to the eyes of users among other slide fastener components. Therefore, as the users are more and more fashion-minded, slider pull tabs are required to be designed for aesthetic purpose. One of increasing trends in the industry is that pull tabs are made available in different materials, shapes, and colors, and a desired pull tab can be selected and combined with a slider body.

Most earlier slider bodies suitable for subsequent connection to selected pull tabs have a pull tab holder to which a circular or oval ring-like pull tab attachment link is coupled. The pull tab is joined to the slider body by inserting a flexible coupling on a front end of the pull tab into the attachment link laterally. With this attachment structure, the link and the pull tab are not coupled to each other with sufficient strength and stability. Moreover, since the flexible coupling is attached to the front end of the pull tab, a pull tab of leather could not be employed, and available pull tabs are limited to certain designs, i.e., not all pull tabs of any desired shape and material can be used.

SUMMARY OF THE INVENTION

In view of the aforesaid problems of the conventional pull tab attachment, it is an object of the present invention to provide a pull tab attachment capable of subsequently attaching pull tabs of any shape, design, and material to a slider body with large coupling strength and stability.

According to the present invention, there is provided a pull tab attachment for attaching a pull tab to a slider body f a slide fastener slider, the pull tab having an end and the slider body having a pull tab retainer, the pull tab attachment comprising an attachment body made of a plastically deformable material, a ring member on one end of the attachment body for being loosely fitted in the pull tab retainer, and a pair of jaws comprising a pair of gripper arms on the opposite end of the attachment body for gripping the end of the pull tab therebetween, the gripper arms having on inner confronting surfaces thereof a plurality of biting teeth extending in different directions for biting engagement with the end of the pull tab gripped between the gripper arms.

Many other advantages and features of the present invention will become manifest to those versed in the art upon making reference to the detailed description and the accompanying sheets of drawings in which preferred structural embodiments incorporating the principles of the present invention are shown by way of example.

DETAILED DESCRIPTION

Figure 1:
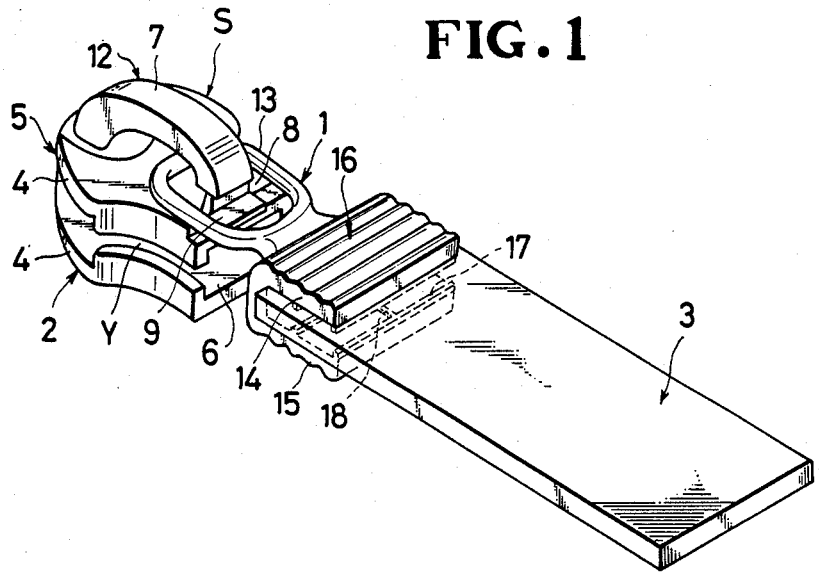
FIG. 1 is a perspective view of a slider with a slider body and a pull tab coupled to each other by a pull tab attachment according to the present invention.

Like or corresponding parts are denoted by like or corresponding reference characters throughout views.

FIG. 1 shows a slide fastener slider S comprising a slider body 2 and a pull tab 3 which are coupled to each other by a pull tab attachment 1 according to an embodiment of the present invention.

Figure 2:
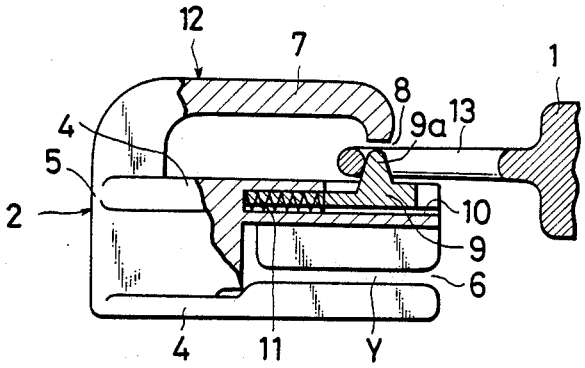
FIG. 2 is a side elevational view, partly broken away, showing the manner in which the slider body and the pull tab are connected to each other.

As shown in FIGS. 1 and 2, the slider body 2 includes a pair of upper and lower wings 4 spaced from each other and interconnected by a diamond or separator 5 at their front end, thus defining a generally Y-shaped guide channel Y through the slider body 2. The slider body 2 also has a pull tab holder 7 mounted on the upper surface of the upper wing 4 and extending from the front end thereof rearwardly toward a throat 6 defined in the rear end of slider body 2 in communication with the guide channel Y. The pull tab holder 7 is substantially of a C shape which is concave downwardly and has a rear end that is spaced a gap 8 from the rear end of the upper wing 4. A slide member 9 having an upwardly projecting ridge 9*a* is slidably disposed in a recess 10 defined in the rear portion of the upper wing 4 and extending from the rear end thereof above the throat 6 toward the front end thereof. The slide member 9 is normally urged in a rearward direction to position the ridge 9*a* in the gap 8 thereby to close the gap 8 by a spring 11 disposed in the upper wing 4. The pull tab holder 7 and the slide member 9 jointly constitute a pull tab retainer 12. The pull tab 3 is shown as being of a rectangular flat shape. However, it may be of any design, shape, and material insofar as it can be attached to the pull tab attachment 1 in the manner described below.

Figure 3:
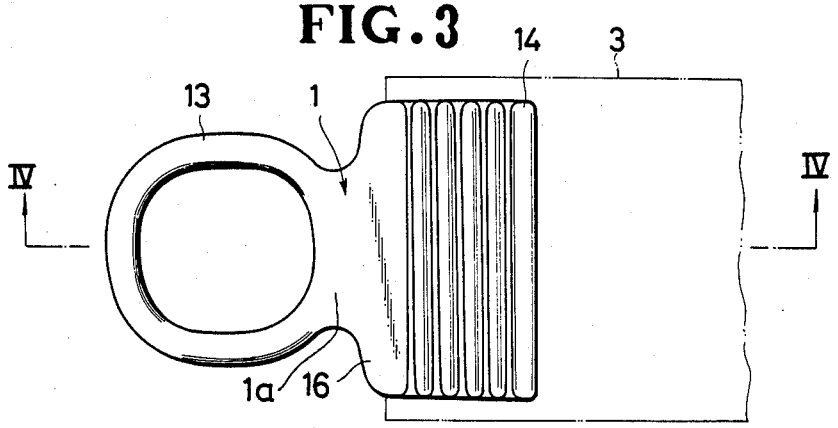
FIG. 3 is plan view of the pull tab attachment.
Figure 4:
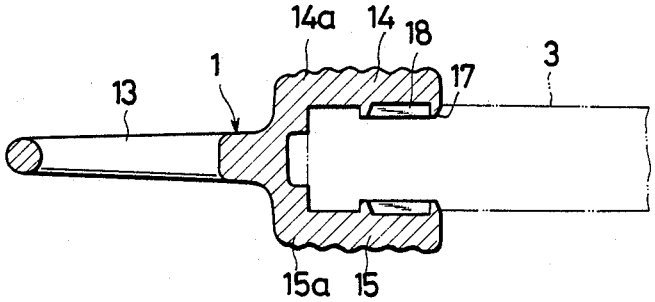
FIG. 4 is a cross-sectional view taken along line IV—IV of FIG. 3.
Figure 5:
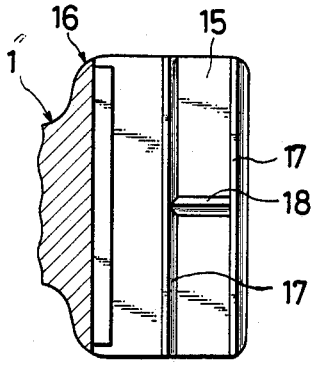
FIG. 5 is a plan view of biting teeth on a jaw of the pull tab attachment.

FIGS. 3 through 5 illustrate the pull tab attachment 1 and the manner in which the pull tab 3 is joined to the pull tab attachment 1. The pull tab attachment 1 is made of a plastically deformable material such as metal such that when it is under a load in excess of its elastic limit as by bending, it will not recover its original shape upon removal of the load. The pull tab attachment 1 has an attachment body 1*a* and an annular member 13 joined to the front end of the attachment body 1*a* and having a thickness which is smaller than the gap 8 of the pull tab retainer 12. The pull tab attachment 1 also has a air of jaws 16 on the rear end of the attachment body 1*a*, the jaws 16 comprising a pair of upper and lower parallel gripper arms 14, 15 for gripping the front end of the pull tab 3 therebetween. The jaws 14, 15 are joined to the attachment body 1*a* through respective proximal ends 14*a*, 15*a*. The upper and lower gripper arms 14, 15 each have on their inner confronting surfaces two parallel biting teeth 17 extending transversely of the pull tab attachment 1 and a biting tooth 18 extending longitudinally of the pull tab attachment 1 between the biting teeth 17 at their intermedate portions, as shown in FIG. 5, the biting teeth 17, 18 substantially assuming the shape of an H.

The slider body 2, the pull tab 3, and the pull tab attachment 1 are assembled toether as follows: The front end of the pull tab 3 is inserted between the upper and lower gripper arms 14, 15 of the jaws 16 of the pull tab attachment 1, and then the upper and lower gripper arms 14, 15 are pressed against the pull tab 3 by a suitable tool or press. The jaws 16 are deformed, by staking, to cause the biting teeth 17, 18 on the inner surfaces of the gripper arms 14, 15 to bite into the upper and lower surfaces of the front end of the pull tab 3. The pull tab attachment 1 and the pull tab 3 are now firmly united as shown in FIG. 4. Then, the annular member 13 of the pull tab attachment 1 is inserted into the gap 8 while pushing the ridge 9*a* of the slide member 9 forwardly against the bias of the spring 11, until the annular member 13 is placed in the pull tab retainer 12. Then, the ridge 9*a* of the slide member 9 is released from the annular member 13 and the slide member 9 is automatically returned to the original position under the force of the spring 11, thus closing the gap 8, as shown in FIG. 2. Therefore, the slider body 2 and the pull tab 3 are interconnected by the pull tab attachment 1, as illustrated in FIG. 1.

As described above, the pull tab 3 can be joined to the pull tab attachment 1 simply by pressing the gripper arms 14, 15 against the front end of the pull tab 3 inserted therebetween. Therefore, no special structure needs to be added to the front end of the pull tab 3 for attachment to the pull tab attachment 1, but the front end of the pull tab 3 is only required to be of a flat configuration. Accordingly, the pull tab 3 with a flat front end, which may be of any shape, design, and material, can easily be coupled to the slider body 2 through the pull tab attachment 1. Because a choice is available out of many different types of pull tabs, the pull tab attachment 1 is suitable for subsequently attaching a freely selected pull tab to the slider body 2.

Figure 6:
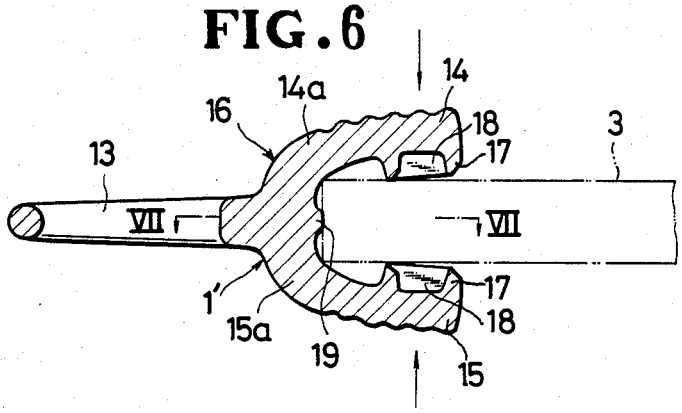
FIG. 6 is a cross-sectional view of a pull tab attachment according to another embodiment of the present invention.
Figure 7:
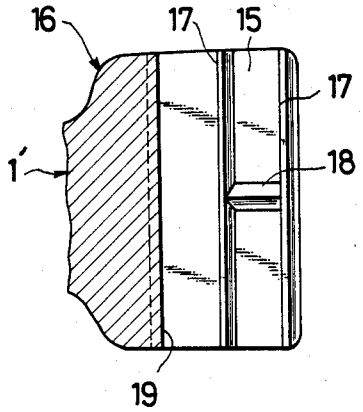
FIG. 7 is a cross-sectional view taken along line VII—VII OF FIG. 6.

FIGS. 6 and 7 show a pull tab attachment 1′ in accordance with another embodiment of the present invention. The pull tab attachment 1′ has a pair of jaws 16 including a pair of gripper arms 14, 15 having curved proximal portions 14*a*, 15*a*, respectively, so that the gripper arms 14, 15 can easily be deformed toward each other. The pull tab attachment 1′ also includes a positioning land 19 disposed on an inner central surface where the jaws 16 are joined to each other. The positioning land 19 engages the front end of the pull tab 3 when the pull tab 3 is inserted between the jaws 16, for thereby positioning the pull tab 3 accurately with respect to the pull tab attachment 1′.

Figure 8:
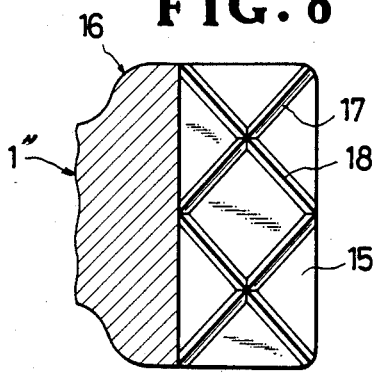
FIG. 8 is a plan view of biting teeth on a jaw of a pull tab attachment according to a modification.

FIG. 8 shows a modified pull tab attachment 1″. The pull tab attachment 1″ has a pair of gripper arms (only the gripper arm 15 is shown) having on their inner confronting surfaces pairs of biting teeth 17, 18 which obliquely cross each other in the pattern of an X in each pair.

Obviously, various modifications and variations of the present invention are possible in the light of the above teaching. It is therefore to be understood that within the scope of the appended claims the invention may be practiced otherwise than as specifically described.

What is claimed is:

1. A pull tab attachment for attaching a pull tab to a slider body of a slide fastener slider, the pull tab having an end and the slider body having a pull tab retainer, said pull tab attachment comprising:

an attachment body made of a plastically deformable material;

a ring member on one end of said attachment body for being loosely fitted in the pull tab retainer; and a pair of jaws comprising a pair of gripper arms on the opposite end of said attachment body for gripping the end of the pull tab therebetween, said gripper arms having on inner confronting surfaces thereof a plurality of biting teeth extending in different directions for biting engagement with the end of the pull tab gripped between said gripper arms.

2. A pull tab attachment according to claim 1, said gripper arms extending parallel to each other.

3. A pull tab attachment according to claim 1, said gripper arms having curved proximal ends joined to said attachment body.

4. A pull tab attachment according to claim 1, said biting teeth including two parallel biting teeth extending transversely of the pull tab attachment and a biting tooth extending longitudinally of the pull tab attachment between said two biting teeth.

5. A pull tab attachment according to claim 4, said biting teeth substantially assuming the shape of an H.

6. A pull tab attachment according to claim 1, said biting teeth include at least one pair of biting teeth obliquely crossing each other.

7. A pull tab attachment according to claim 6, said biting teeth substantially assuming the shape of an X.

8. A pull tab attachment according to claim 1, said attachment body having a positioning land on an inner surface where said jaws are joined to the attachment body.

* * * * *